US010258219B2

(12) United States Patent
Ayaroglu et al.

(10) Patent No.: US 10,258,219 B2
(45) Date of Patent: Apr. 16, 2019

(54) HOUSEHOLD APPLIANCE COMPRISING A LOCK

(71) Applicant: ARCELIK ANONIM SIRKETI, Istanbul (TR)

(72) Inventors: Emre Ayaroglu, Istanbul (TR); Celal Vatansever, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 621 days.

(21) Appl. No.: 14/782,594

(22) PCT Filed: Mar. 28, 2014

(86) PCT No.: PCT/EP2014/056348

§ 371 (c)(1),
(2) Date: Oct. 5, 2015

(87) PCT Pub. No.: WO2014/161793

PCT Pub. Date: Oct. 9, 2014

(65) Prior Publication Data

US 2016/0037995 A1 Feb. 11, 2016

(30) Foreign Application Priority Data

Apr. 5, 2013 (TR) ..... A 2013/04143

(51) Int. Cl.
*A47L 15/42* (2006.01)
*D06F 49/00* (2006.01)
(Continued)

(52) U.S. Cl.
CPC ..... *A47L 15/4259* (2013.01); *D06F 29/005* (2013.01); *D06F 39/14* (2013.01);
(Continued)

(58) Field of Classification Search
CPC ..... Y10T 292/0911; Y10T 292/0926; Y10T 292/0928; Y10T 292/0934;
(Continued)

(56) References Cited

U.S. PATENT DOCUMENTS 362,152 A * 5/1887 Ferren ..... E05B 65/0007 292/210
576,242 A * 2/1897 Voight ..... E05B 85/22 292/192
(Continued)

FOREIGN PATENT DOCUMENTS

DE 10350710 A1 5/2005
DE 202011106274 U1 12/2011
(Continued)

OTHER PUBLICATIONS

International Search Report or PCT/EP2014/056348.
Written Opinion of the International Search Authority for PCT/EP2014/056348.

*Primary Examiner* — Carlos Lugo
(74) *Attorney, Agent, or Firm* — Kilpatrick Townsend & Stockton LLP

(57) ABSTRACT

The present invention relates to a household appliance (1) comprising a front wall (2); an opening (3) that is disposed on the front wall (2) and that enables the items to be placed therein; a cover (4) closing the opening (3), a tenon (5) disposed on the cover (4); and a lock (9) disposed on the front wall (2) and having a body (6) that remains behind the front wall (2), a latch (7) that is pivotally connected to the body (6), that the tenon (5) rotates by pushing while being placed into the body (6), that enables the tenon (5) to be kept inside the body (6) and that has a locking position (C) wherein the tenon (5) is kept inside the body (6) and a free position (O) changed by rotating as the tenon (5) is dislodged, and the lock (9) further having a spring (8), one end
(Continued)

Figure 1:
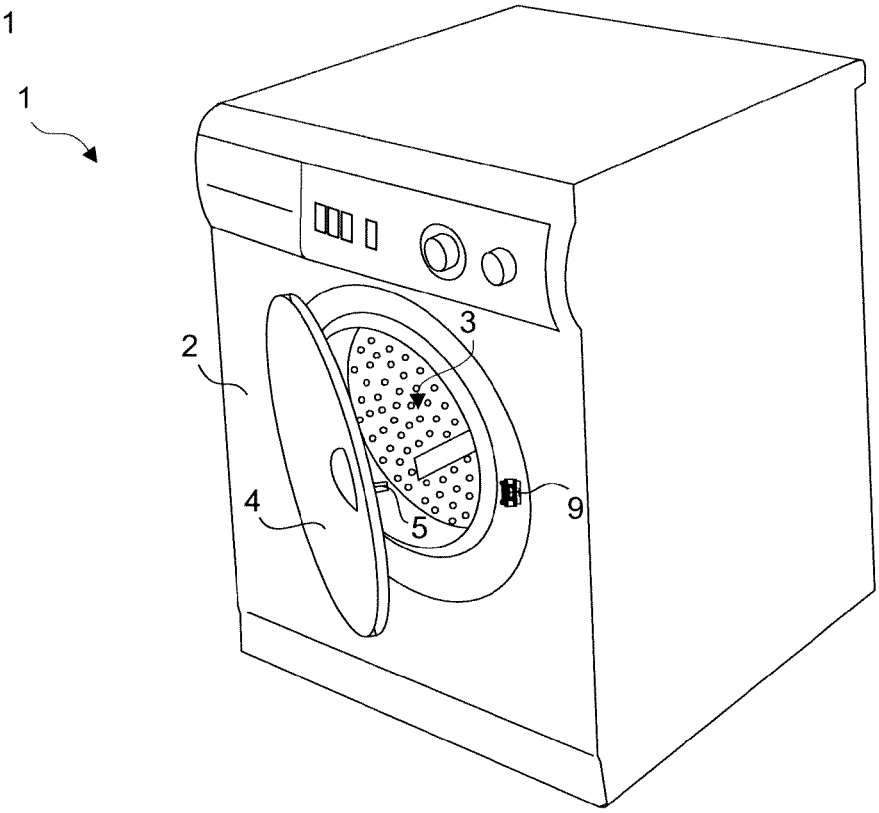

of which is connected to the body (6), one end to the latch (7), that is compressed by the rotation of the latch (7) and that enables the latch (7) to resume its former position by transferring the stored energy to the latch (7) when the latch (7) becomes free.

12 Claims, 4 Drawing Sheets

(51) Int. Cl.
*D06F 39/14* (2006.01)
*D06F 29/00* (2006.01)
*D06F 58/04* (2006.01)

(52) U.S. Cl.
CPC ..... *D06F 49/003* (2013.01); *D06F 58/04* (2013.01); *Y10S 292/69* (2013.01); *Y10T 292/0911* (2015.04); *Y10T 292/0926* (2015.04); *Y10T 292/1051* (2015.04)

(58) Field of Classification Search
CPC ..... Y10T 292/1043; Y10T 292/1051; Y10T 292/1052; Y10T 292/1061; Y10T 292/0932; Y10T 292/1059; Y10S 292/20; Y10S 292/47; Y10S 292/69
USPC ..... 292/95, 96, 99, 101, 121, 122, 128, 194, 292/195, 198, 202, 219, 220, 228
See application file for complete search history.

(56) References Cited

U.S. PATENT DOCUMENTS 966,926 A * 8/1910 Knapp ..... E05F 3/02 16/49
1,269,467 A * 6/1918 Leonard ..... E05B 85/243 292/216
1,474,028 A * 11/1923 Hamm ..... E05B 85/24 292/220
2,031,302 A * 2/1936 Clark ..... A61G 17/02 27/DIG. 1
2,726,108 A * 12/1955 Walter ..... E05C 3/14 292/106
2,737,407 A * 3/1956 Matthews ..... E05C 3/30 27/DIG. 1
2,833,578 A * 5/1958 Burke ..... E05C 19/024 292/216
3,260,813 A * 7/1966 Dargene ..... A47L 15/4259 200/61.64
3,506,292 A * 4/1970 Hagendoorn ..... E05C 19/024 292/216
4,192,536 A * 3/1980 Laureano ..... E05C 3/14 292/228
4,718,705 A 1/1988 Case
4,907,831 A * 3/1990 Di Giusto ..... E05B 85/26 292/210
5,461,755 A * 10/1995 Hardigg ..... A45C 13/26 16/438
5,630,630 A * 5/1997 Price ..... E05B 17/2003 292/128
5,741,032 A * 4/1998 Chaput ..... E05B 65/0811 292/202
5,823,017 A 10/1998 Hapke et al.
5,927,772 A * 7/1999 Antonucci ..... E05B 83/30 292/336.3
6,443,505 B1 * 9/2002 Linares ..... E05B 17/04 292/1
6,913,296 B2 * 7/2005 Bassi ..... A47L 15/4259 292/122
6,974,164 B2 * 12/2005 Brewster ..... B60P 7/13 292/104
7,004,517 B2 * 2/2006 Vitry ..... E05B 47/0002 292/144
7,032,973 B2 * 4/2006 Reubeuze ..... B60N 2/01541 292/121
7,210,711 B2 * 5/2007 Dirnberger ..... A47L 15/4259 292/223
7,347,460 B2 * 3/2008 Ala ..... A47L 15/4259 292/216
7,481,469 B2 * 1/2009 Harrer ..... F24C 15/022 292/201
7,644,963 B2 * 1/2010 Fan ..... E05C 19/10 292/121
7,959,194 B2 * 6/2011 Mahoney ..... E05B 53/003 292/121
8,276,951 B2 * 10/2012 Dirnberger ..... A47L 15/4259 292/216
9,267,315 B2 * 2/2016 Lee ..... D06F 39/14
2002/0056997 A1 * 5/2002 Bassi ..... E05B 17/22 292/226
2002/0073752 A1 6/2002 Dirnberger et al.
2008/0169657 A1 * 7/2008 Horton ..... E05B 83/30 292/220
2012/0119522 A1 5/2012 Bauriedl
2012/0161594 A1 6/2012 Kim et al.
2015/0035295 A1 * 2/2015 Li ..... E05B 15/029 292/219

FOREIGN PATENT DOCUMENTS

DE 102010051518 A1 5/2012
EP 134448 A1 3/1985
KR 20100104886 A 9/2010
WO 02/36907 A2 5/2002
WO 2008/096222 A2 8/2008
WO 2009/061628 A1 5/2009
WO 2012084483 A1 6/2012

* cited by examiner

HOUSEHOLD APPLIANCE COMPRISING A LOCK

The present invention relates to a household appliance comprising a lock.

In household appliances, the cover used for loading and unloading the items is enabled to be kept in the closed position by means of a lock. Locking is realized by the placement of a tenon generally disposed on the cover into a lock disposed on the front wall of the body.

In the state of the art embodiment, the International Patent Application No. WO2012084483, a washer/dryer, comprising a lock group wherein the lock group is mounted on the front wall is explained.

Another state of the art embodiment is explained in the European Patent Application No. EP134448 In this application, a lock mechanism that is included in the electrical household appliance is disclosed.

In these state of the art embodiments, various additional stopper surfaces that are disposed on the body and that enable the rotational movement of the latch to be ended are required. These additional surfaces increase the production costs.

The aim of the present invention is the realization of a household appliance comprising a lock that provides ease of assembly and production, and furthermore decreases inventory costs.

In the household appliance realized in order to attain the aim of the present invention and explicated in the claims, a lock is realized, that comprises a stopper disposed on a pin that ends the rotation of a latch while a tenon is pushed into the lock and similarly ends the rotation of the latch in the reverse direction while the tenon is taken out of the lock.

In an embodiment of the present invention, the stopper enables the latch to remain in the locking position (C) and/or the free position (O) by bearing against the wall of the bearing. Thus, the stopper extending from over the pin enables the rotation of the latch to be ended by contacting the wall of the bearing during the rotation of the pin.

In an embodiment of the present invention, the stopper is integrated with the pin.

In an embodiment of the present invention, the stopper has at least one inclined surface. The surface of the stopper contacting the body at the locking position (C) and the surface of the stopper contacting the body at the free position (O) are not completely parallel to one another, having a certain limit angle therebetween predetermined by the producer. One of these surfaces is inclined with respect to the other. Thus, the surface that contacts the body during the rotation of the pin maintains this contact along the surface area.

In an embodiment of the present invention, the stopper extends from over the pin along the length of the bearing. Thus, the pressure applied by the stopper to the wall of the bearing continues all along the wall. Thus, the latch is kept in a more stable manner in the locking position (C) or the free position (O).

In an embodiment of the present invention, the latch is integrated with the pin.

In an embodiment of the present invention, the bearing is semicircular.

In an embodiment of the present invention, the lock comprises a circular recess arranged on the pin and a protrusion located on the bearing that is disposed almost all along the bearing and whereon the recess is seated.

In an embodiment of the present invention, the lock comprises two pins that are located on the latch and that extend in opposite directions on the same axis, and two bearings that are disposed on the body and that face one another, whereon the pins are seated. Thus, the stoppers disposed on each pin enable the latch to stay in a stable manner.

By means of the present invention, the production cost of the lock used in the household appliance is enabled to be decreased.

The model embodiments relating to a household appliance realized in order to attain the aim of the present invention are illustrated in the attached figures, where:

FIG. 1—is the perspective view of a household appliance.

Figure 2:
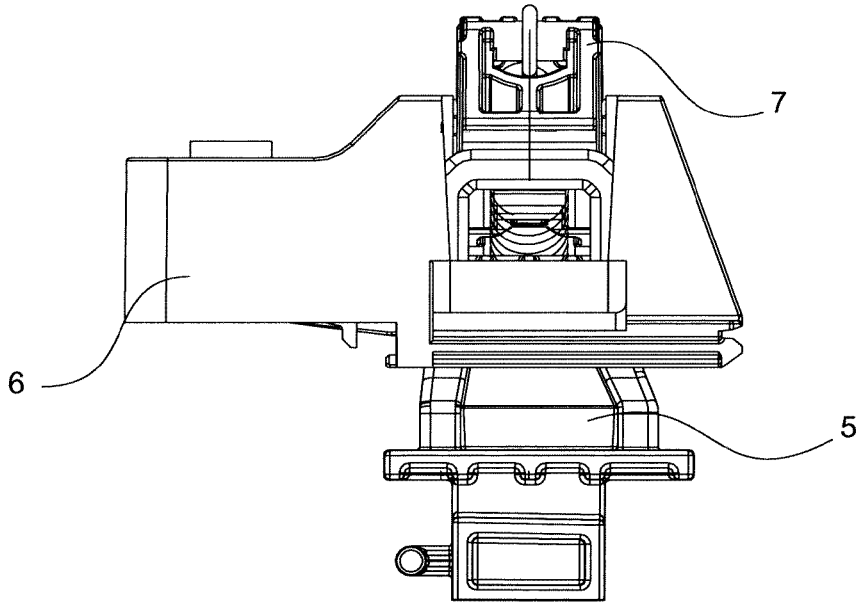

FIG. 2—is the top view of the lock and the tenon when the tenon is inserted into the lock in a household appliance.

Figure 3:
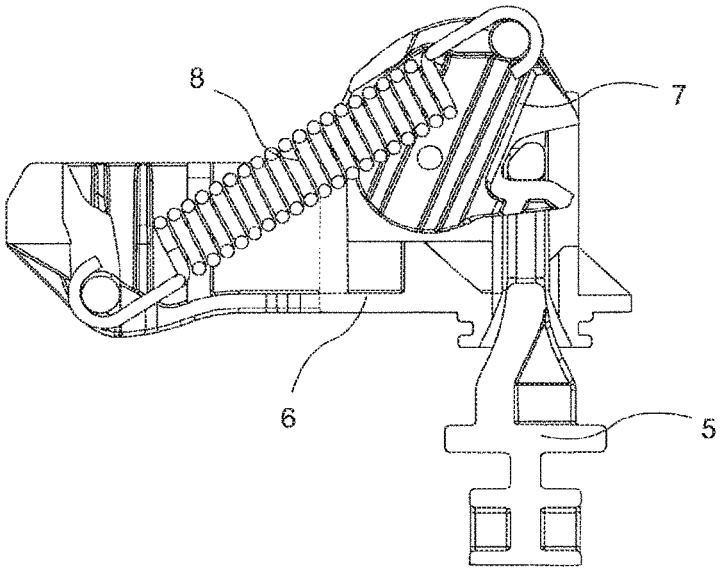

FIG. 3—is the sideways partial cross-sectional view of the lock when the tenon is inserted into the lock in a household appliance.

Figure 4:
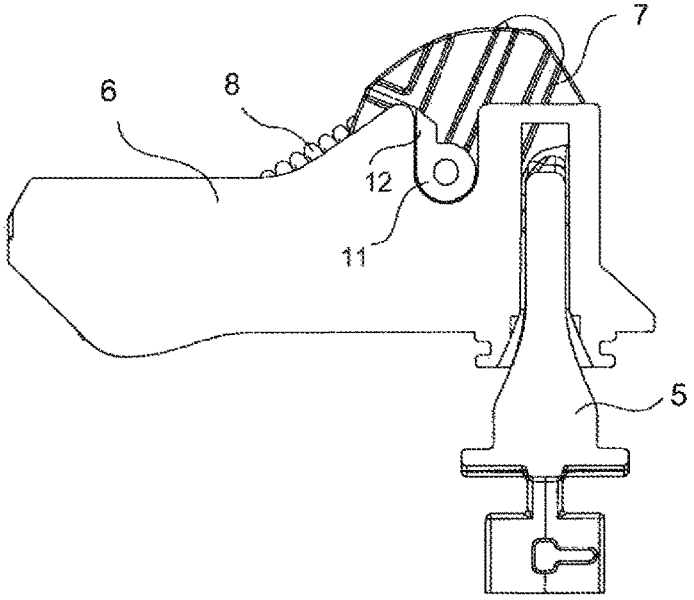

FIG. 4—is the sideways view of the lock when the tenon is inserted into the lock in a household appliance.

Figure 5:
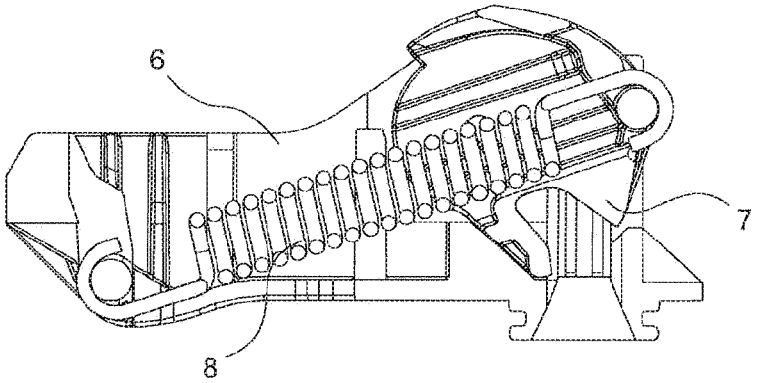

FIG. 5—is the sideways partial cross-sectional view of the lock when the latch is in the free position (O) in a household appliance.

Figure 6:
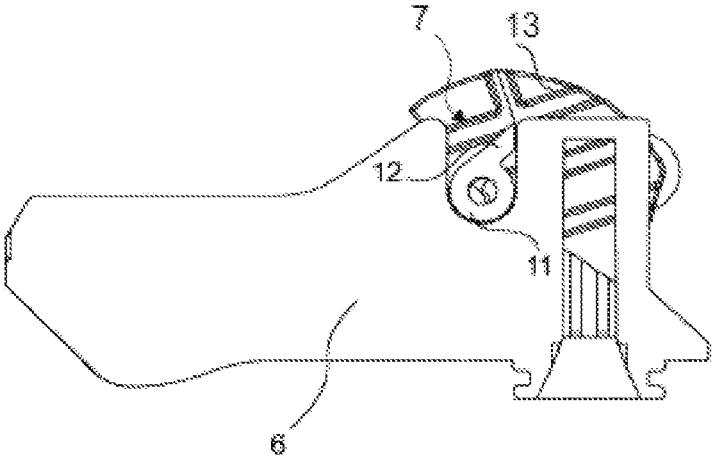

FIG. 6—is the sideways view of the lock when the latch is in the free position (O) in a household appliance.

Figure 7:
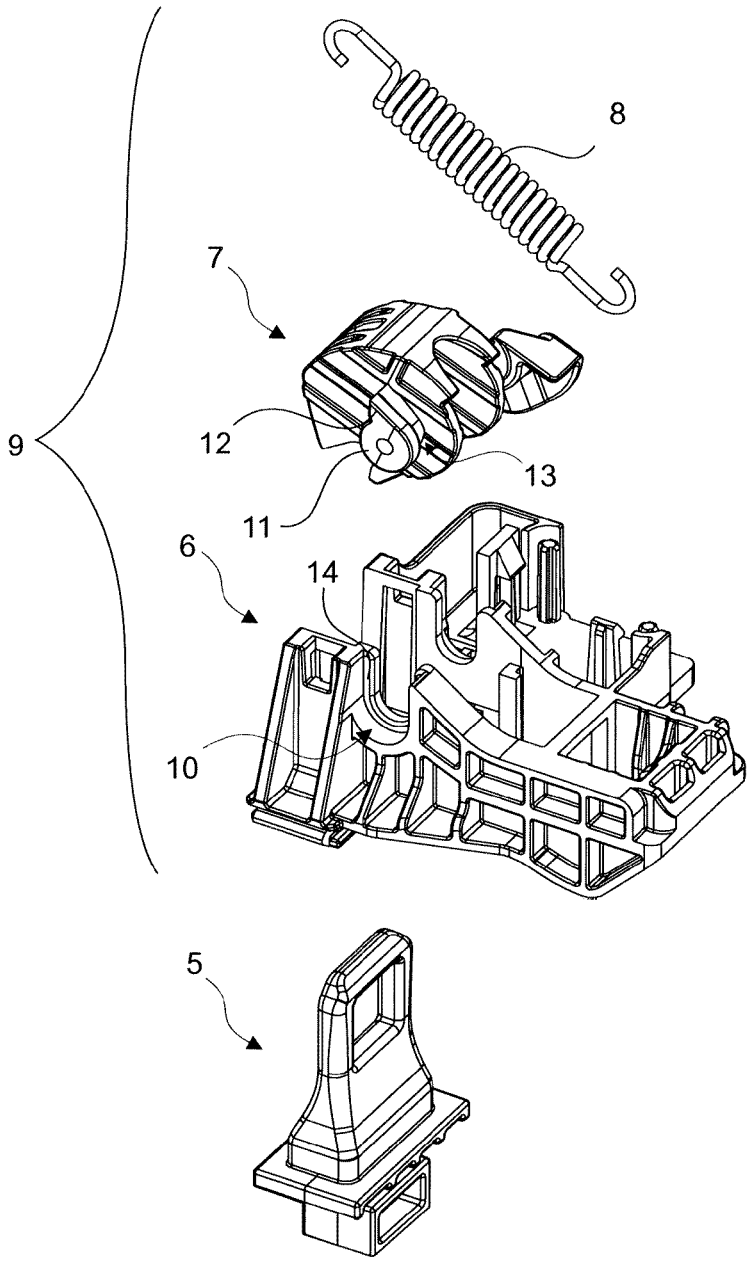

FIG. 7—is the exploded view of the lock in a household appliance.

The elements illustrated in the figures are numbered as follows:

1. Household appliance
2. Front wall
3. Opening
4. Cover
5. Tenon
6. Body
7. Latch
8. Spring
9. Lock
10. Bearing
11. Pin
12. Stopper
13. Recess
14. Protrusion The household appliance (1) comprises

- a front wall (2),
- an opening (3) that is disposed on the front wall (2) and that enables the items to be placed therein,
- a cover (4) closing the opening (3),
- a tenon (5) disposed on the cover (4) and
- a lock (9) that is disposed on the front wall (2) and that has
- a body (6) that remains at the rear side of the front wall (2),
- a latch (7) that is pivotally connected to the body (6), that the tenon (5) rotates by pushing while being placed into the body (6), that enables the tenon (5) to be kept inside the body (6), and that has a locking position (C) wherein the tenon (5) is kept inside the body (6) and a free position (O) whereto it is changed by rotating as the tenon (5) is dislodged,
- a spring (8), one end of which is connected to the body (6), one end to the latch (7), that is compressed by the rotation of the latch (7) and that enables the latch (7) to resume its former position by transferring the stored energy to the latch (7) when the latch (7) becomes free.

In the household appliance (1) of the present invention, the lock (9) comprises:

- at least one bearing (10) situated on the body (6), at least one pin (11) that is disposed on the latch (7) and that enables the latch (7) to be pivotally connected into the bearing (10), a stopper (12) that is disposed on the pin (11), that extends outside from the periphery of the pin (11) in the radial direction and that enables the latch (7) to stop by bearing against the body (6) in the locking position (C) and/or the free position (O).

The tenon (5) located on the cover (4) is seated into the lock (9) that is disposed on the front wall (2) by pushing the cover (4). The tenon (5) that passes through the opening (3) arranged on the body (6) enables the latch (7) to rotate around the rotational axis (E) passing from the center of the pin (11) by pushing the latch (7) situated behind the opening (3). The latch (7) locks the tenon (5) inside the lock (9) during this rotation. The rotational movement of the latch (7) ends as the stopper (12) disposed on the pin (11) bears against the body (6) and the latch (7) remains stable in the locking position (C) by locking the tenon (5) inside the lock (9). As the cover (4) is pulled, the tenon (5) rotates the latch (7), whereto it is connected, in the reverse direction, this rotation of the latch (7) ends when the stopper (12) contacts the body (6) and thus the latch (7) remains stable in the free position (O) wherein the tenon (5) is outside the lock (9). The spring (8) remains at the right side of the rotational axis (E) in the locking position (C) and at the left side in the free position (O). The stopper (12), that enables the latch (7) to remain stable in the locking position (C) and the free position (O), being disposed on the pin (11) eliminates the requirement of forming an additional stopper (12) surface on the surface of the body (6). Consequently, the production costs are decreased and moreover different body (6) designs for different latch (7) designs are not required to be realized.

In an embodiment of the present invention, the stopper (12) enables the latch (7) to remain in the locking position (C) and/or the free position (O) by bearing against the wall of the bearing (10). Thus, the stopper (12) extending from over the pin (11) enables the rotation of the latch (7) to be ended by contacting the wall of the bearing (10) during the rotation of the pin (11).

In an embodiment of the present invention, the stopper (12) and the pin (11) are integrated as a single piece. Thus, ease of production is provided.

In an embodiment of the present invention, the stopper (12) has at least one inclined surface. The surface of the stopper (12) contacting the body (6) at the locking position (C) and the surface of the stopper (12) contacting the body (6) at the free position (O) are not completely parallel to one another, having a certain limit angle therebetween predetermined by the producer. One of these surfaces is inclined with respect to the other. Thus, the surface that contacts the body (6) during the rotation of the pin (11) maintains this contact along the surface area.

In an embodiment of the present invention, the stopper (12) extends from over the pin (11) in the direction of the length of the bearing (10). Thus, the pressure applied by the stopper (12) to the wall of the bearing (10) continues all along the wall. Thus, the latch (7) is kept in a more stable manner in the locking position (C) or the free position (O).

In an embodiment of the present invention, the stopper (12) and the pin (11) are integrated as a single piece. Thus, ease of production is provided.

In an embodiment of the present invention, the bearing (10) is U-shaped. Thus, the pin (11) situated on the latch (7) can be easily seated on the bearing (10) and the pin (11) can easily rotate on the wall of the bearing (10) around the rotational axis (E).

In an embodiment of the present invention, the lock (9) comprises a circular recess (13) arranged on the pin (11) and a protrusion (14) that is disposed on the bearing (10) almost all along the bearing (10) and whereon the recess (13) is seated.

In an embodiment of the present invention, the lock (9) comprises two pins (11) that are located on the latch (7) and that extend in opposite directions on the same axis, and two bearings (10) that are disposed on the body (6) and that face one another and whereon the pins (11) are seated. Thus, the stoppers (12) disposed on each pin (11) enable the latch (7) to remain in a stable manner.

In an embodiment of the present invention, the household appliance (1) is a washing machine.

In an embodiment of the present invention, the household appliance (1) is a laundry washer/dryer.

In an embodiment of the present invention, the household appliance (1) is a laundry dryer.

In an embodiment of the present invention, the household appliance (1) is a dishwasher.

By means of the present invention, a lock (9) is realized, the production cost and inventory cost of which are decreased and which is used in the household appliance (1).

The invention claimed is:

1. A household appliance comprising:

a front wall, an opening that is disposed on the front wall and enables items to be placed therein, a cover closing the opening, a tenon disposed on the cover and a lock that is disposed on the front wall and that has:

a body that remains at a rear side of the front wall, a latch that is pivotally connected to the body, which the tenon rotates by pushing while being placed into the body, that enables the tenon to be kept inside the body and that has a locking position wherein the tenon is kept inside the body and a free position whereto it is changed by rotating as the tenon is dislodged, a spring, one end of which is connected to the body, one end to the latch, that is compressed by the rotation of the latch and that enables the latch to resume its former position by transferring stored energy to the latch when the latch becomes free, wherein the lock further comprises:

a pair of bearings situated on the body, each bearing defining a U-shaped configuration;

a pair of pins that is disposed on opposite outer surfaces of the latch and that enables the latch to be pivotally connected into the bearings, wherein the latch is configured to rotate around a rotational axis passing from a center of the pins, and a stopper that is disposed on at least one of the pins, that extends outside from periphery of the pin in a radial direction, the stopper defining a first stopper surface and a second stopper surface that is inclined with respect to the first stopper surface, the stopper enables the latch to stop in the locking position by bearing the first stopper surface against a surface of the U-shaped configuration of the bearing, and in the free position by bearing against the second stopper surface against an opposite surface of the U-shaped configuration of the bearing.

2. The household appliance as in claim 1, wherein the stopper is integrated with the pin.

3. The household appliance as in claim 1, wherein the stopper extends from over the pin in a direction of a length of the bearing.

4. The household appliance as in claim 1, wherein the pin is integrated with the latch.

5. The household appliance as in claim 1, wherein the lock has a circular recess arranged adjacent to the pin and a protrusion is disposed on the bearing and whereon the circular recess is seated, wherein the circular recess remains between the pin and the outer surface of the latch.

6. The household appliance as in claim 1 wherein the pins extend in opposite directions on a same axis, and the bearings are disposed on the body, that face one another and whereon the pins are seated.

7. The household appliance as in claim 1, which is a washing machine.

8. The household appliance as in claim 1, which is a laundry washer/dryer.

9. The household appliance as in claim 1, which is a laundry dryer.

10. The household appliance as in claim 1, which is a dishwasher.

11. The household appliance as in claim 1, wherein the stopper is integrated with the pin.

12. The household appliance as in claim 1, wherein the spring remains at a first side of the rotational axis in the locking position, and wherein the spring remains at a second side opposite to the first side of the rotational axis in the free position.

* * * * *